US012635766B2

(12) United States Patent
Steele

(10) Patent No.: US 12,635,766 B2
(45) Date of Patent: May 26, 2026

(54) SHOE INSERT HAVING A FOOT PATH DIRECTOR

(71) Applicant: Stuart Steele, West Milford, NJ (US)

(72) Inventor: Stuart Steele, West Milford, NJ (US)

( * ) Notice: Subject to any disclaimer, the term of this patent is extended or adjusted under 35 U.S.C. 154(b) by 0 days.

(21) Appl. No.: 18/941,429

(22) Filed: Nov. 8, 2024

(65) Prior Publication Data

US 2025/0151849 A1 May 15, 2025

Related U.S. Application Data

(60) Provisional application No. 63/548,055, filed on Nov. 10, 2023.

(51) Int. Cl.

| | |
|---|---|
| ***A43B 17/00*** | (2006.01) |
| ***A43B 7/149*** | (2022.01) |
| ***A43B 7/24*** | (2006.01) |
| ***A43B 13/14*** | (2006.01) |

(52) U.S. Cl.

CPC ..... *A43B 17/00* (2013.01); *A43B 7/149* (2013.01); *A43B 7/24* (2013.01); *A43B 13/141* (2013.01)

(58) Field of Classification Search

CPC ..... A43B 17/00; A43B 19/00; A43B 7/24; A43B 13/141

USPC ..... 36/44, 43, 142, 143, 144

See application file for complete search history.

(56) References Cited

U.S. PATENT DOCUMENTS

| | | | | | |
|---|---|---|---|---|---|
| 1,872,987 | A | | 8/1932 | Langer | |
| 2,226,392 | A | * | 12/1940 | Sbicca | A43B 13/38 36/43 |
| 2,263,187 | A | | 11/1941 | Parkhurst | |
| 2,280,440 | A | | 4/1942 | Melchionna | |
| 2,312,124 | A | * | 2/1943 | Rosenzweig | A43D 113/00 36/76 R |
| 2,680,919 | A | * | 6/1954 | Riggs | A43B 7/1425 36/155 |
| 2,865,097 | A | | 12/1958 | Vollrath et al. | |
| 3,757,435 | A | | 9/1973 | Schwartz | |
| 4,305,212 | A | * | 12/1981 | Coomer | A43B 13/14 36/44 |
| 4,841,647 | A | * | 6/1989 | Turucz | A43B 7/146 36/43 |
| 5,722,186 | A | * | 3/1998 | Brown | A43B 7/143 36/43 |
| 5,921,009 | A | * | 7/1999 | Hice | A43B 13/143 36/43 |
| 6,141,890 | A | * | 11/2000 | Chtn | A43B 7/1445 36/43 |
| 6,349,487 | B1 | * | 2/2002 | Hice | A43B 13/143 36/43 |
| 6,578,290 | B1 | * | 6/2003 | Meynard | A43B 13/146 36/103 |
| 7,832,119 | B2 | * | 11/2010 | Gilmore | A61F 5/14 36/180 |

(Continued)

FOREIGN PATENT DOCUMENTS

| | | |
|---|---|---|
| NL | 6405923 A | 11/1965 |

*Primary Examiner* — Marie D Bays

(74) *Attorney, Agent, or Firm* — Myers Wolin, LLC

(57) ABSTRACT

An insertable insole is provided for use with footwear. The insertable insole includes an elongated rib originating at a heel end of the insole and extending substantially linearly towards a forefoot end of the insole. The rib is spaced apart from lateral edges of the insole.

10 Claims, 4 Drawing Sheets

(56) References Cited

U.S. PATENT DOCUMENTS 8,127,467 B2 * 3/2012 Koyama ..... A43B 7/142 36/103
8,453,347 B2 * 6/2013 Kawahara ..... A43B 7/223 36/154
9,078,484 B2 * 7/2015 Hennig ..... A43B 7/00
2003/0033733 A1 * 2/2003 Brooks ..... A43B 7/142 36/31
2007/0295451 A1 * 12/2007 Willis ..... A43B 9/16 36/43
2008/0127515 A1 * 6/2008 Lohrer ..... A43B 13/145 36/43
2009/0293307 A1 * 12/2009 Koyama ..... A43B 13/148 36/28
2011/0185600 A1 * 8/2011 Malek ..... A43B 7/1463 36/43
2011/0247235 A1 * 10/2011 de Roode ..... A43B 7/142 12/18.1
2012/0151803 A1 * 6/2012 Selner ..... A43B 7/1464 36/144
2013/0139407 A1 * 6/2013 Brongers ..... A43B 1/0045 36/44
2013/0283646 A1 * 10/2013 Selner ..... A43B 7/00 36/144
2015/0173457 A1 * 6/2015 Saito ..... A43B 13/40 36/44
2015/0351494 A1 * 12/2015 Jung ..... A43B 17/08 36/44
2017/0006961 A1 * 1/2017 Pedersen ..... A43B 7/149
2017/0027277 A1 * 2/2017 Anthony ..... A43B 7/1463
2017/0251757 A1 * 9/2017 Meschter ..... A43B 13/184
2019/0320758 A1 * 10/2019 Radovic ..... A43B 7/141
2019/0373985 A1 * 12/2019 Schwartz ..... A43B 7/141

* cited by examiner

SHOE INSERT HAVING A FOOT PATH DIRECTOR

CROSS REFERENCE TO RELATED APPLICATIONS

This application takes priority from U.S. Provisional Application No. 63/548,055, filed Nov. 10, 2023, the contents of which are incorporated by reference herein.

FIELD OF THE INVENTION

The invention relates to a shoe insert or orthotic having a foot path director that modifies the path normally taken by the human foot.

BACKGROUND

A typical path the human foot takes for the majority of humans throughout the world is inefficient. Known as the "S Curve Path of the Foot," the typical path begins at the heel, moves to the outer metatarsal, then across the forefoot pad and then up the big toe. This long and inefficient path taken by each foot generates rotational moments in the foot that can cause fatigue. Due to the predominant masses of the heel, outer metatarsal, forefoot pad and big toe, the proprioceptors within each those masses are stimulated, signaling the balance system of the body that controls leg and foot muscles to respond to the "S Curve Path of the Foot." Fatigue and wasted energy results from the motion of the "S" Curve Foot Path. A typical person loses approximately 30% of the energy transferred to their feet in the form of heat as a result of such an inefficient foot path.

The prior art as is best known to the inventor is partially represented by U.S. Pat. No. 1,872,987 (1932) to Langer entitled Shoe Insole; U.S. Pat. No. 2,865,097 (1958) to Vollrath entitled Inner Sole Lining & for Shoes; and U.S. Pat. No. 3,757,435 (1973) to Schwartz entitled Biased Tensioned Insole Member for Boots and Shoes.

U.S. Pat. No. 2,865,097 (1958) to Vollrath entitled Inner Sole Lining & for Shoes describes the principal object of the invention to provide a lining for the inner sole of a shoe. The patent further describes a strip of adhesive material throughout its length for the purpose of adhering the insole to the inside of a shoe. Vollrath, does not describe the strip for adhering the insole to the inside of a shoe for the purpose of stimulating proprioceptors of human feet.

U.S. Pat. No. 1,872,987 (1932) to Langer refers to a recession in a shoe insert for the seam line of a stocking affecting the nerves of a human foot. The depression is not described in any way for the purpose of stimulating proprioceptors of human feet.

U.S. Pat. No. 3,757,435 (1973) to Schwartz, describes a plurality of radiating elements, tensioned rubber strands acting as springs added to the sole of a shoe or boot for the purpose of storing energy for release as the wearer completes his or her stride. The tensioned rubber strands are not described for the purpose of stimulating the proprioceptors of human feet.

There is a need for a foot path director that can generate or assist a user in generating a more efficient foot path, thereby conserving energy and improving the user's stride. Earlier iterations of foot path directors had complex designs, including, e.g., linear metal components. There is a need for a foot path director that is simpler to implement than a linear metal path director. There is a further need for a foot path director that is durable and easily manufactured and implemented in the context of shoe insoles.

SUMMARY

In some embodiments, a system is provided for normalizing foot motion. The system may include a shoe or other footwear including an outer sole.

An insole is then proportioned for use with said outer sole, said insole having a heel region and a forefoot region, said insole including, upon that surface of said insole facing said outer sole, an elongated longitudinal shallow semi-rigid, non-structural rib originating at said heel region and extending to approximately the heel-direction end of said forefoot region along an axis originating at about the center of the heel and pointing to between the large and third toes inclusive of the foot, and said rib further comprising a length of between about six and about fourteen centimeters.

Also provided is an insertable insole for use with footwear, the insertable insole including an elongated rib originating at a heel end of the insole and extending substantially linearly towards a forefoot end of the insole. The rib is spaced apart from lateral edges of the insole.

In some embodiments, the insole is configured such that, when used, the rib defines an axis extending substantially from a center of a user's heel to a location between an outer edge of the large toe and an inner edge of a third toe of the user. In some such embodiments, the location between an outer edge of the large toe and an inner edge of a third toe of the user is a location substantially between the big toe and a second toe of the user.

In some embodiments, the rib comprises a substrate of a shoe sole.

In some embodiments, the rib defines, in transverse cross-section, an inverted catenary.

In some embodiments, the rib is flared at the heel end of the insole, such that the rib is wider at the heel end than at the forefoot end of the insole.

In some such embodiments, the insole is a partial insole such that, when used, the insole terminates at or adjacent a forefoot pad of a user.

In some such embodiments, a forefoot end of the insole is sloped so as to provide a gradual transition from the insole to a surface of a sole, and the rib terminates prior to the sloping of the insole.

In some embodiments, the insole comprises a substrate, and the rib extends from the substrate of the insole.

In some such embodiments, the rib extends from a bottom surface of the substrate of the insole.

In some such embodiments, a fabric covering is applied to a top surface of the substrate of the insole.

In some embodiments, the rib and substrate are formed from a single material.

DETAILED DESCRIPTION OF THE PREFERRED EMBODIMENTS

Figure 1:
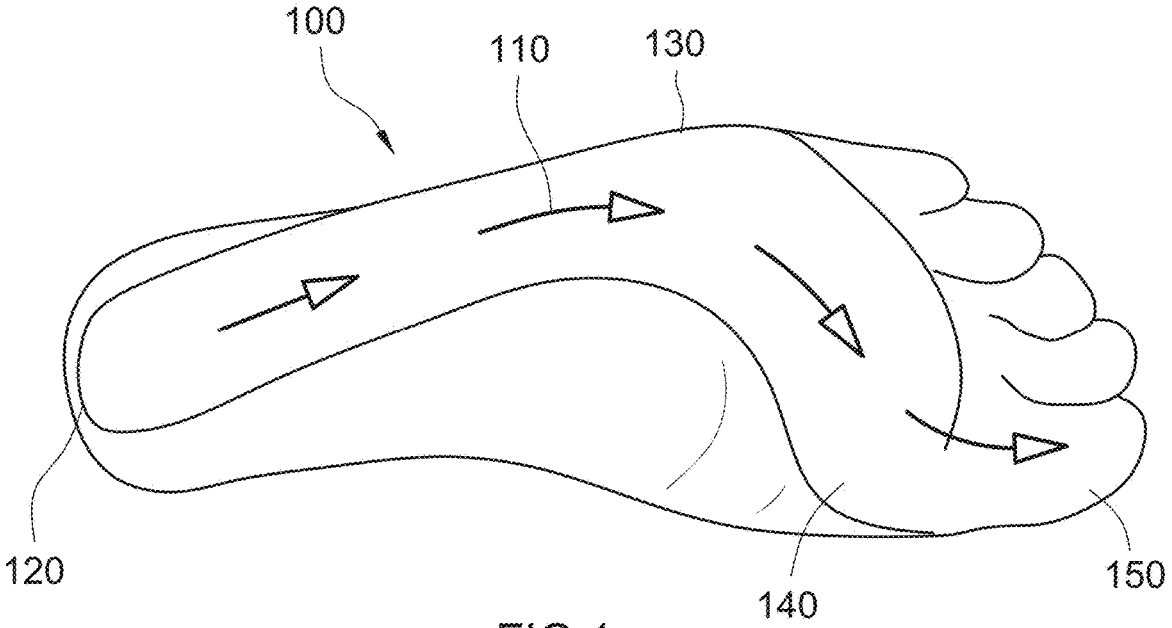
FIG. 1 is a view of the typical "S Curve Path" of the Foot.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

This disclosure relates to the addition of a flared portion of the Foot Path Director located at the heel portion of the Shoe Insert for the purpose of stabilizing the initial contact of the heel of a human's foot to the Shoe Insert attached to the Foot Path Director based on the angle of initial heel contact and any terrain slope deviation as the heel, shoe insert, Foot Path Director and shoe make contact with the ground. Reduced rotational heel moments are largely reduced or eliminated as is fatigue with the addition of flaring the heel portion of the Foot Path Director.

The Foot Path Director component of the Shoe Insert is designed to stimulate certain force sensors, (proprioceptors). Proprioceptors are specialized nerves, sensory receptors located on the nerve endings of the inner ear, muscles, skin, joints, tendons, and other tissues. Proprioceptors signal information to the balance system of the body about position and movement of body parts, for example the angle at a joint or the length of a muscle. The balance system in turn signals muscles of the body—in this case, the leg and foot muscles to respond, to follow stimulated proprioceptors, making adjustments to leg and foot muscles to maintain attitude balance.

It is understood that the shoe insert described herein can, in some embodiments, also function as an orthotic and provide related benefits.

FIG. 1 shows a typical path 110 the human foot 100 takes for the majority of humans throughout the world. Known as the "S Curve Path of the Foot," the path 110 begins at the heel 120, moves to the outer metatarsal 130, then across the forefoot pad 140 and then up the big toe 150. This long path taken by each foot 100 generates rotational moments in the foot that cause fatigue. Due to the predominant masses of the heel 120, outer metatarsal 130, forefoot pad 140 and big toe 150, the proprioceptors within each those masses are stimulated, signaling the balance system of the body that controls leg and foot muscles to respond to the "S Curve Path of the Foot." Fatigue and wasted energy results from the motion of the "S" Curve Foot Path 110. A typical person loses approximately 30% of the energy transferred to their feet in the form of heat as a result of the inefficient "S" Curve Foot Path, shown in FIG. 1.

Figure 2:
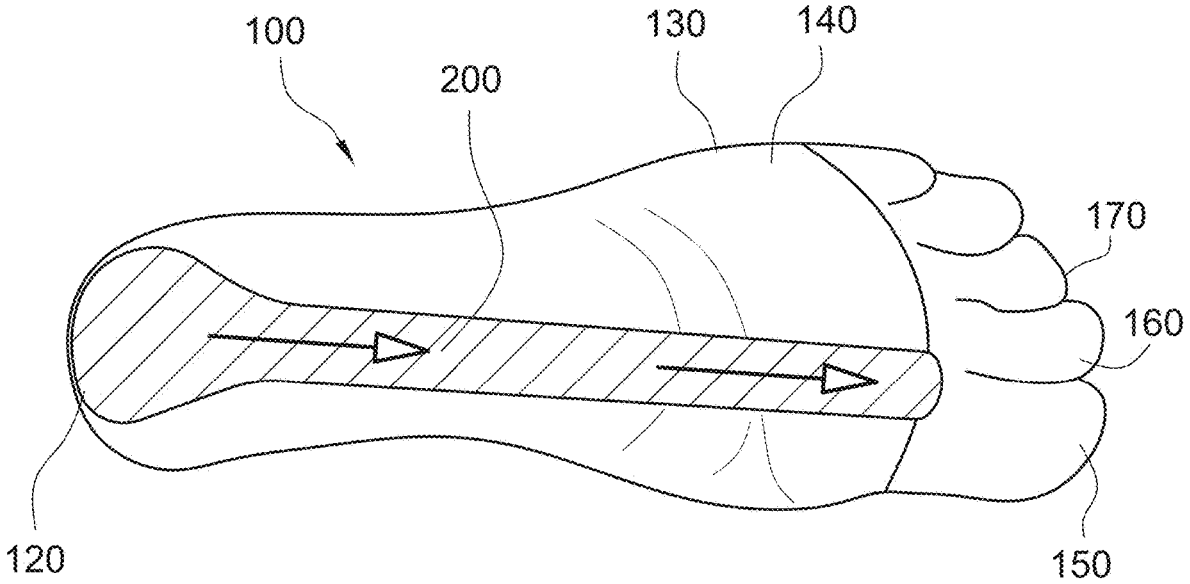
FIG. 2 is a view of the Present Invention "Path Director" shoe insert.

FIG. 2 shows the Foot Path 200 of the present disclosure, with the purpose of stimulating the proprioceptors of the foot with a Foot Path Director 310 to direct the foot 100 in a path from the heel along the "Strain Line of the Foot," the path 200 from the heel 120 to between the big toe 150 and the second toe 160. The shortest distance between two points is a straight line corresponding to the foot path 200 of this disclosure. The Foot Path Director 310 stimulates proprioceptors from the heel 120 toward the generalized location between the big and second toe 150, 160 saving roughly 15% or more of the physical distance between the two locations. By performing this action, the majority of foot rotational moments are reduced and the physical path length is reduced, reducing foot fatigue and permitting a faster pace speed.

Figure 3:
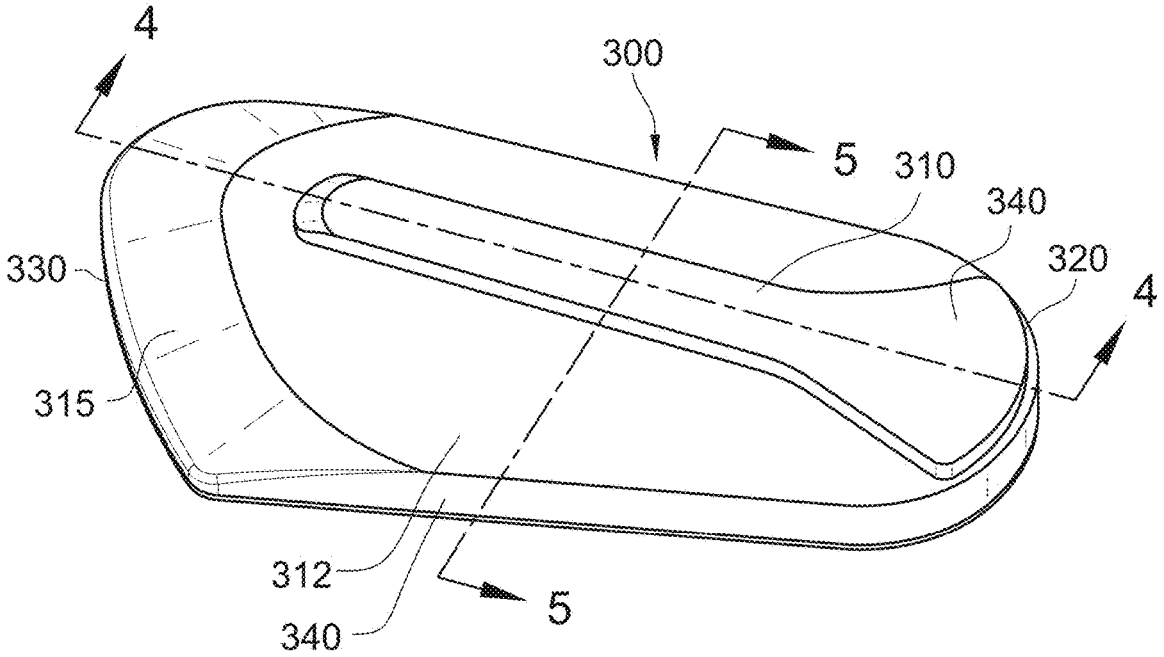
FIG. 3 is a bottom perspective view of the Present Invention Shoe Insert with Path Director.
Figure 4:
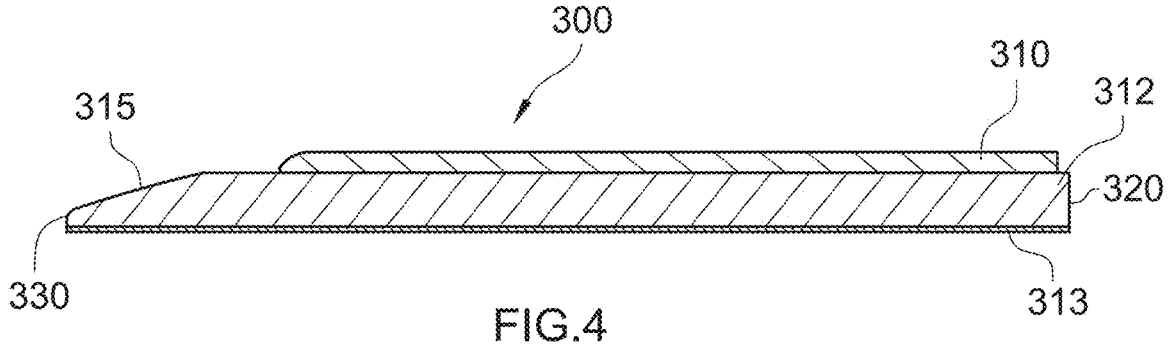
FIG. 4 is a longitudinal section view of the Present Invention Shoe Insert with Path Director taken along line 4-4 of FIG. 3.
Figure 5:
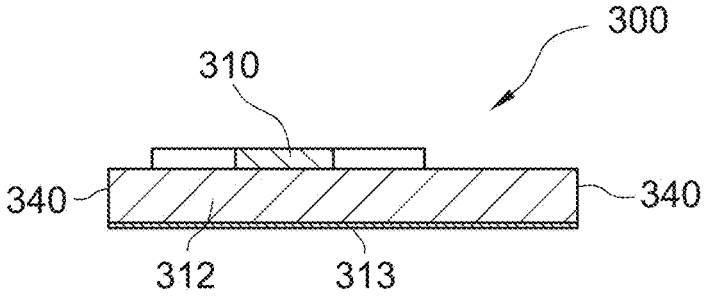
FIG. 5 is a cross sectional view of the Present Invention Shoe Insert with Path Director taken along line 5-5 of FIG. 3.
Figure 6:
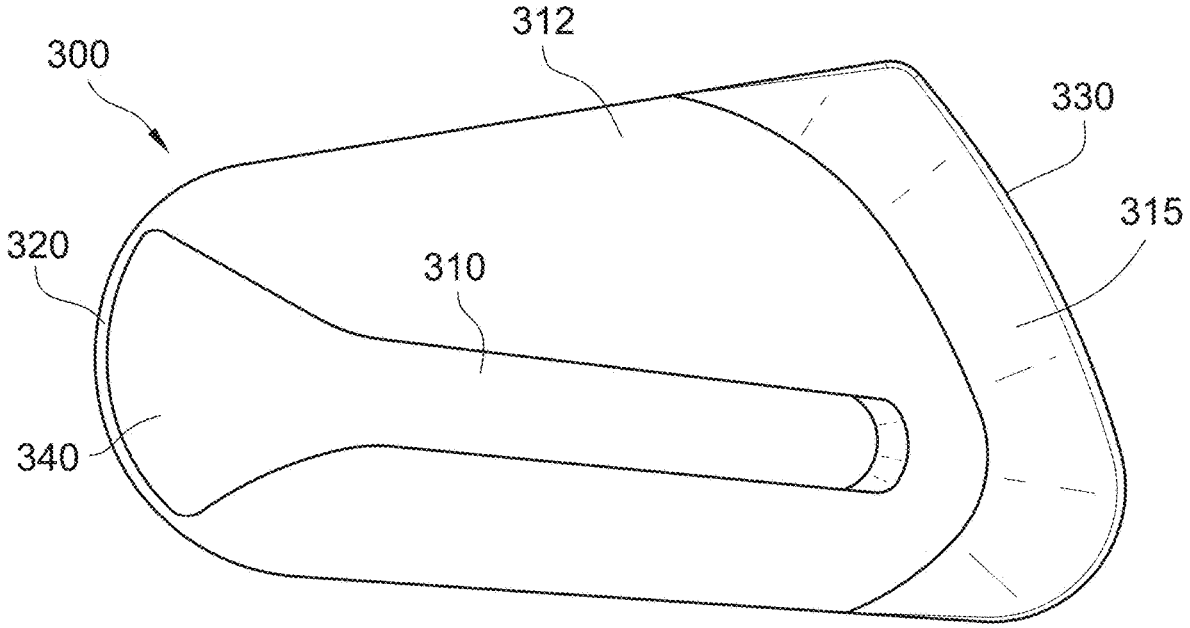
FIG. 6 is a plan view of the bottom of the shoe insert of FIG. 3.

FIG. 3 is a bottom perspective view of the Present Invention Shoe Insert 300 with Path Director 310. FIG. 4 is a longitudinal section view of the Present Invention Shoe Insert 300 with Path Director 310 taken along line 4-4 of FIG. 3. FIG. 5 is a cross sectional view of the Present Invention Shoe Insert 300 with Path Director 310 taken along line 5-5 of FIG. 3. FIG. 6 is a plan view of the bottom of the shoe insert 300 of FIG. 3.

In the shoe insert 300 shown, a Footpath Director 310 is mounted to the shoe insert substrate 312. The function of the Footpath Director is to stimulate the proprioceptors, (force sensors) in the feet with the intention to direct the path of the feet to follow the direction of the Footpath Director 310 from the heel 320 to between the big toe 150 and second toe 160 along the Strain Line of the Foot 200 versus between the second 160 and third toe 170 in earlier implementations.

This passive bio-mechanical device 300 is comprised of three components: the Foot Path Director 310 mounted to the bottom or top of the Shoe Insert Substrate 312 as well as a fabric topping 313.

The use of a shortened Shoe Insert Substrate 312 with a thicker substrate located from the heel of the foot to just behind the forefoot pad of the foot 140. The thicker substrate 312 may be sloped 315 behind the forefoot pad. A shallow semi-rigid full length shoe insert substrate is an alternative solution, a variation of which is shown, e.g., in FIG. 8.

In the shortened version, the insertable insole 300 extends from a heel end 320 to forefoot end 330 of the insole, and the footpath director 310, also referred to herein as a rib 310, extends from the heel end 320 of the insole substantially linearly towards a forefoot end of the insole. In the shortened version, the forefoot end 330 of the insole 300 rests adjacent or just prior to a user's forefoot pad 140.

As shown, the rib 310 extends substantially linearly from the heel end 320 towards the forefoot end 330, and the rib 310 is generally spaced apart from lateral edges 340 of the insole 300. In some embodiments, the rib 310 may be substantially centered between the lateral edges 340 of the insole 300.

As shown, when used, the rib 310 may define an axis extending substantially from a center of a user's heel 120 to a location between an outer edge of the user's large toe 150 and an inner edge of the user's third toe 170. In the embodiment shown, the location is a location substantially between the big toe 150 and the second toe 160 of the user. In such an embodiment, the axis defined substantially corresponds to the idealized foot path 200 shown in FIG. 2.

In some embodiments, the rib 310 may comprise a substrate of a shoe sole, and may thereby be incorporated into a shoe rather than an independent insertable insole.

In some embodiments, the rib 310 is substantially planar, such that it extends from a substrate 312 of the insole 300 and defines a flat surface spaced apart from a surface of the substrate of the insole. This is shown, for example, in FIG. 5. In other embodiments, the rib 310 may define other shapes, such as a convex shape. In some embodiments, the rib 310 may define, in transverse cross-section, an inverted catenary.

The Footpath Director 310 may then be a shallow semi-rigid rib. As shown, in some embodiments, the rib may be flared at the heel end 320 of the insole 300. Accordingly, a section 340 of the rib 310 adjacent the heel end 320 of the insole 300 may be wider than the rib at other locations. Such a flared section 340 at the heel 120 of the foot 100 may then provide a stable first foot contact entry, reducing/removing initial rotational motion due to initial angular heel contact with the shoe insert and resulting terrain contact as the foot/shoe insert/shoe complex interact.

Both the Shoe Insert Substrate 312 and the Footpath Director, or rib 310, are made of the same or dissimilar materials. Same materials permit a consistent compression while dissimilar materials compress differently providing a different performance/comfort result for the user. A preferred shoe insert substrate and Footpath Director material is a high density polyurethane material which can be compression cycled many millions of times prior to destruction. Normally a fabric covering 313 for the shoe insert substrate 312 upon which the user's foot 100 would lay upon is preferable. The thickness of either the shoe insert substrate 312 or Footpath Director 310 can vary. For example: The shoe insert substrate 312 could be ¼ inch thick at the heel 320, 120 and then taper or slope 315 at the forefoot pad 330, 140 perhaps as much as 1/16 inch. The taper or slope 315 could be either on the bottom or the top of shoe insert substrate 312. With a greater thickness at the heel, the user acquires a revised center of gravity forward which provides an enhanced stride versus a consistent thickness shoe insert substrate. With a longer stride, the user reduces the amount of energy, stress and fatigue. The shoe insert substrate 312 could be the same thickness as the Footpath Director 310, for example, ⅛ inch plus minus for each, such that the combined thickness for both is ¼ inch.

Some embodiments may have a ⅛ inch thick by ⅝ inch wide high density polyurethane material of varying length installed on the shoe insert substrate based on shoe size.

In some embodiments, a back surface of the shoe insert 300 may include some adhesive or nonslip material to maintain the device at a specific location once inserted into a shoe.

The device as herein described is a practical improvement for human walking and running for humans who normally have an "S Curve Foot Path."

Figure 7:
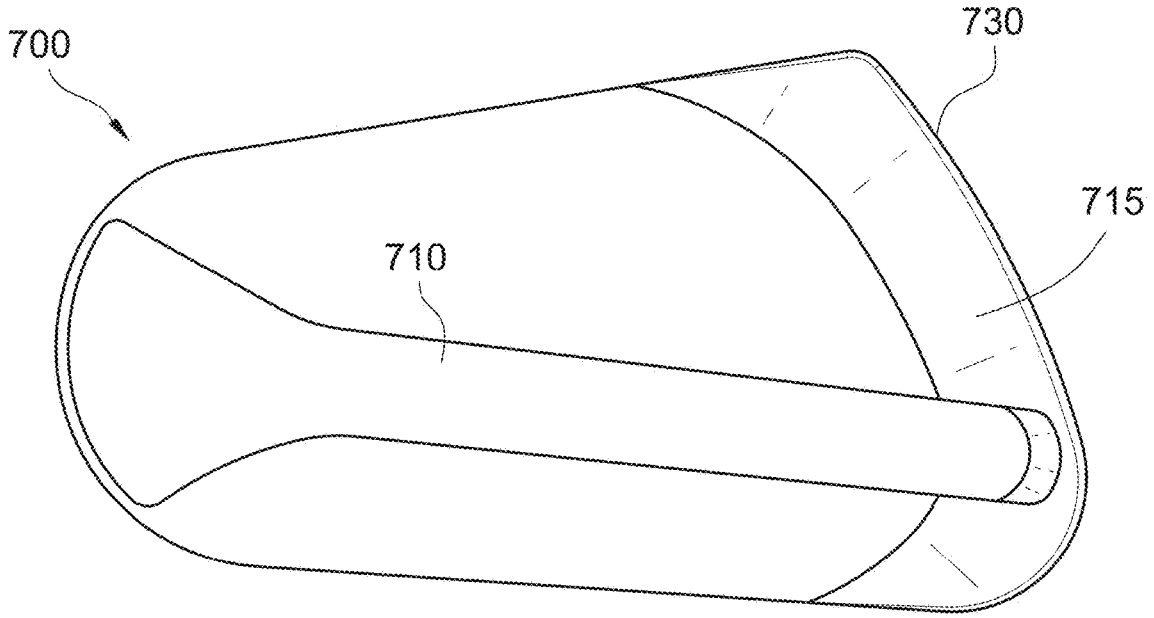
FIG. 7 is a plan view of an alternate embodiment of a shoe insert.

FIG. 7 shows a plan view of an alternate embodiment of a shoe insert 700 similar to that shown in FIG. 3. It is noted that while FIG. 7 shows the path director 710 extending beyond the sloped portion 715 of the leading edge 730, in typical embodiments the path director would terminate prior to the sloped leading edge, as shown in FIG. 6. In some embodiments, the path director 710 would terminate about ½ inch prior to the sloped leading edge 730.

Figure 8:
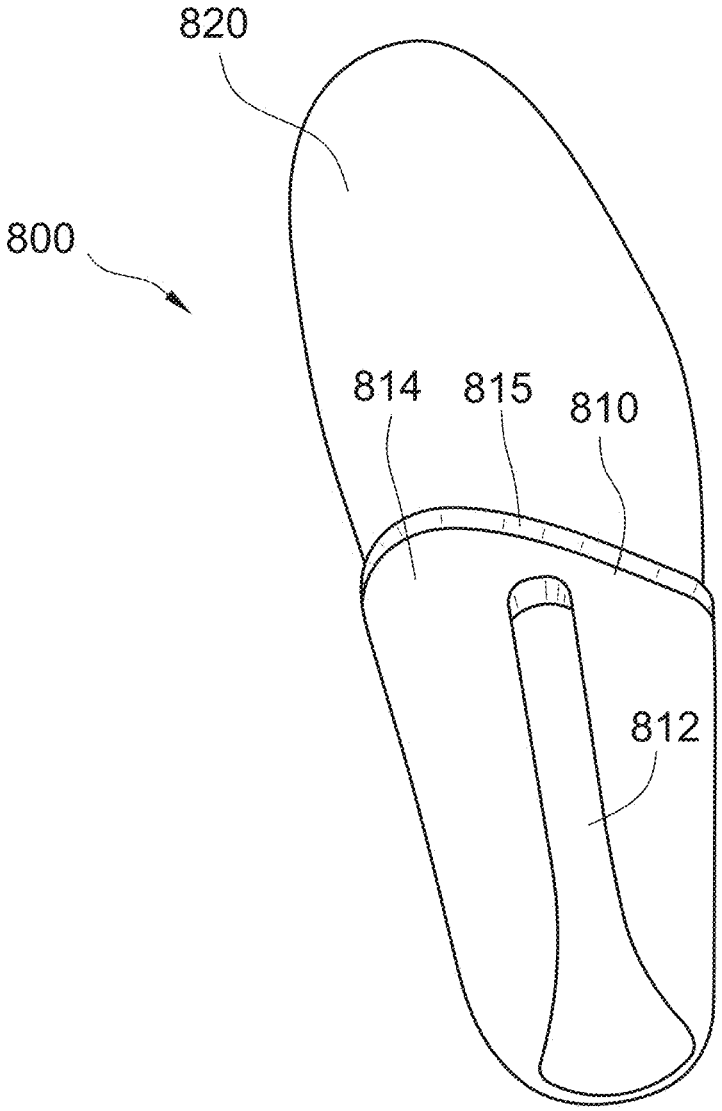
FIG. 8 is an alternate embodiment of a path director shoe insert in accordance with the present invention.

FIG. 8 is an alternate embodiment of a path director shoe insert 800 in accordance with the present invention.

In the embodiment shown, the insole 800 combines a shortened insole segment 810 similar to that discussed above in reference to FIG. 3 which includes a path director or rib 812. The shortened insole segment 810 has a substrate 814, but the substrate provided is generally thinner than that discussed above. Such a substrate may be, for example, ⅛ of an inch thick. A thinner substrate 814 may then reduce or eliminate the need for a sloped section, or a skived section 815. While such a section is still present in the embodiment shown, it is minimized compared to that of FIG. 3.

Limited skiving of the new designs' ⅛ inch thick leading edge 830 shortened insole segment 810 and leading edge of the Path Director or rib 812 may be preferable for foot comfort motion transition during walking/running. The shortened insole segment 810 may then be paired with a full length insert layer 820.

Accordingly, the design shown typically comprises four main components, a fabric covering on the top side of the full length shoe insert 820, not shown, the full length shoe insert substrate 820, the secondary shortened insole segment 810 applied to the underside of the full length shoe insert and the foot path director, or rib 812. The shortened insole segment 810 may be limited in length to behind a person's forefoot pad 140. All three foam parts may be the same thickness, such as approximately ⅛ inch.

Additional design considerations are contemplated as well. One such design is ⅛ inch thick material of the present disclosure. Another such design is ⅛ inch thick material in the embodiment shown with the same secondary part adhered to the previous part with it's leading edge about one inch behind the first part with the path director on the bottom of the secondary part.

A method is further contemplated for adhering a shoe insert to the shoe insole, such that the insert is permanently or semi permanently installed within the shoe.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A system for normalizing foot motion, comprising:

a shoe including an outer sole; and an insole proportioned for use with said outer sole, the insole comprising an elongated rib originating at a heel end of the insole and extending substantially linearly towards a forefoot end of the insole, said rib spaced apart from lateral edges of the insole and extending from a center of the heel area of the insole to a location between a medial edge of the insole and a location between the medial edge and a central longitudinal axis of the insole so that when used the rib would define an axis extending substantially from a center of a user's heel to a location between an outer edge of the large toe and an inner edge of a third toe of the user, wherein the rib is flared at the heel end of the insole, such that the rib is wider at the heel end than at the forefoot end of the insole.

2. An insertable insole for use with footwear, comprising:

an elongated rib originating at a heel end of the insole and extending substantially linearly towards a forefoot end of the insole, said rib spaced apart from lateral edges of the insole and extending from a center of the heel area of the insole to a location between a medial edge of the insole and a location between the medial edge and a central longitudinal axis of the insole so that when used the rib would define an axis extending substantially from a center of a user's heel to a location between an outer edge of the large toe and an inner edge of a third toe of the user, wherein the rib is flared at the heel end of the insole, such that the rib is wider at the heel end than at the forefoot end of the insole.

3. The insole of claim 2 configured such that, when used, the axis extends substantially from the center of the user's heel to, the rib extends from a center of the heel area of the insole to a location approximately half way between a medial edge of the insole and a location between the medial edge and the longitudinal axis of the insole so that when used the rib would define an axis extending substantially from a center of a user's heel to a location substantially between the big toe and a second toe of the user.

4. The insole of claim 2 in which said rib defines, in transverse cross-section, an inverted catenary.

5. The insole of claim 2 wherein the insole is a partial insole such that, when used, the insole terminates at or adjacent a forefoot pad of a user.

6. The insole of claim 5 wherein a forefoot end of the insole is sloped so as to provide a gradual transition from the insole to a surface of a sole, and wherein the rib terminates prior to the sloping of the insole.

7. The insole of claim 2 wherein the insole comprises a substrate, and wherein the rib extends from the substrate of the insole.

8. The insole of claim 7 wherein the rib extends from a bottom surface of the substrate of the insole.

9. The insole of claim 8 wherein a fabric covering is applied to a top surface of the substrate of the insole.

10. The insole of claim 8 wherein the rib and substrate are formed from a single material.

* * * * *